US009669633B1

(12) United States Patent
Nishimura

(10) Patent No.: US 9,669,633 B1
(45) Date of Patent: Jun. 6, 2017

(54) INK PORT ADAPTER FOR INKJET HEAD

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/058,093

(22) Filed: Mar. 1, 2016

(51) Int. Cl.
*B41J 2/175* (2006.01)

(52) U.S. Cl.
CPC ..... *B41J 2/17523* (2013.01)

(58) Field of Classification Search
CPC ..... B41J 2/17523
See application file for complete search history.

(56) References Cited

U.S. PATENT DOCUMENTS

2005/0012780 A1* 1/2005 Gil ..... B41J 2/145 347/43
2010/0134571 A1* 6/2010 Shimizu ..... B41J 2/14233 347/85

* cited by examiner

*Primary Examiner* — Stephen Meier
*Assistant Examiner* — Alexander D Shenderov
(74) *Attorney, Agent, or Firm* — Duft Bornsen & Fettig, LLP

(57) ABSTRACT

Ink port adapters for multi-color inkjet heads. In one embodiment, the ink port adapter includes two hose fittings for connecting to hoses, and four openings that align with four ink ports of a four-color inkjet head. The adapter includes one ink path that connects one of the hose fittings to two of the openings, and another ink path that connects the other hose fitting to the other two openings. The adapter therefore converts the four-color inkjet head into a two-color inkjet head.

12 Claims, 9 Drawing Sheets

INK PORT ADAPTER FOR INKJET HEAD

FIELD OF THE INVENTION

The following disclosure relates to the field of printing, and in particular, to inkjet heads used in printing.

BACKGROUND

Inkjet printing is a type of printing that propels drops of ink (also referred to as droplets) onto a medium, such as paper, a substrate for 3D printing, etc. The core of an inkjet printer includes one or more print heads (referred to herein as inkjet heads) having multiple ink channels arranged in parallel to discharge droplets of ink. A typical ink channel includes a nozzle, a chamber, and a mechanism for ejecting the ink from the chamber and through the nozzle, which is typically a piezoelectric actuator connected to a diaphragm. To discharge a droplet from an ink channel, a drive circuit provides a drive waveform to the piezoelectric actuator of that ink channel that includes a jetting pulse. In response to the jetting pulse, the piezoelectric actuator generates pressure oscillations inside of the ink channel to push the droplet out of the nozzle. The drive waveforms provided to individual piezoelectric actuators control how droplets are ejected from each of the ink channels.

Inkjet heads are typically configured as single-color, two-color, or four-color heads. Users select the type of inkjet head based on their printing needs. For example, if a user has a need for both two-color and four-color printing, then they will select both a two-color and a four-color inkjet head. Users may therefore need to purchase multiple types of inkjet heads based their printing needs.

SUMMARY

Embodiments described herein include adapters for multi-color inkjet heads that reduce the number of colors that are printed with the inkjet heads. For example, an adapter may allow a four-color inkjet head to print in two-color or single-color. An adapter may allow a two-color inkjet head to print in single-color. Therefore, use of adapters as described herein advantageously gives users flexibility in how multi-color inkjet heads are used for printing.

One embodiment is an apparatus including an ink port adapter. The ink port adapter comprises a body having a first surface and a second surface, two hose fittings that extend from the first surface of the body for connecting to hoses, four openings on the second surface of the body that align with four ink ports on one end of a four-color inkjet head, a first ink path through the body that connects a first one of the hose fittings to a first one of the openings and to a second one of the openings, and a second ink path through the body that connects a second one of the hose fittings to a third one of the openings and to a fourth one of the openings. This type of ink port adaptor is for converting a four-color inkjet head to a two-color inkjet head.

In another embodiment, the apparatus includes o-rings to be compressed between the four openings of the ink port adapter and the four ink ports of the inkjet head.

In another embodiment, the o-rings are seated in recesses in the four ink ports of the inkjet head.

In another embodiment, the apparatus further includes fastening members configured to attach the ink port adapter to the four-color inkjet head.

In another embodiment, the ink port adapter further includes a plurality of connecting holes through the body to align with threaded holes on the inkjet head. The fastening members are inserted through the connecting holes of the ink port adapter to screw into the threaded holes on the inkjet head.

In another embodiment, a first one of the hose fittings connects with a first hose that supplies a first color of ink, and a second one of the hose fittings connects with a second hose that supplies a second color of ink.

Another embodiment is an apparatus that includes an ink port adapter. The ink port adapter includes a body having a first surface and a second surface, a hose fitting that extends from the first surface of the body for connecting to a hose, four openings on the second surface of the body that align with four ink ports on one end of a four-color inkjet head, and an ink path through the body that connects the hose fitting to each of the openings. This type of ink port adaptor is for converting a four-color inkjet head to a single-color inkjet head.

Another embodiment is an apparatus that includes an ink port adapter. The ink port adapter includes a body having a first surface and a second surface, a hose fitting that extends from the first surface of the body for connecting to a hose, two openings on the second surface of the body that align with two ink ports on one end of a two-color inkjet head, and an ink path through the body that connects the hose fitting to each of the openings. This type of ink port adaptor is for converting a two-color inkjet head to a single-color inkjet head.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
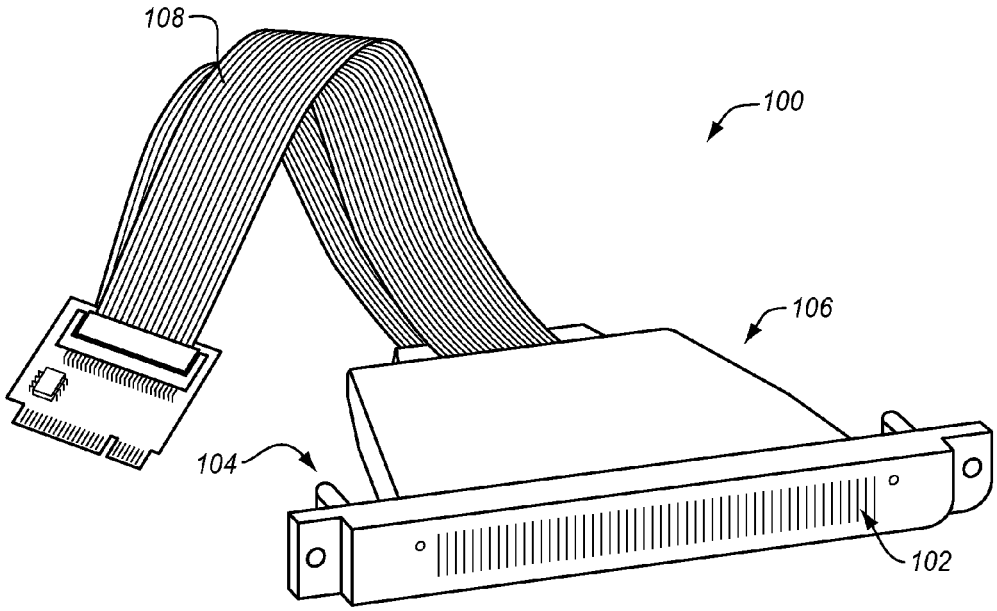
FIG. 1 illustrates an inkjet head.

FIG. 1 illustrates an inkjet head 100. Although not visible in FIG. 1, inkjet head 100 includes a nozzle surface 102 with one or more rows of nozzles that jet or eject droplets of liquid material, such as ink (e.g., water, solvent, oil, or UV-curable). Opposite the nozzle surface 102 is the side of inkjet head 100 used for input/output (I/O) of ink, electronic signals, etc. This side of inkjet head 100 is referred to as the I/O side 104. I/O side 104 includes electronics 106 that connect to a data source through cabling 108. Electronics 106 control how the nozzles of inkjet head 100 jet droplets of ink. As will be described in more detail below, I/O side 104 also includes ink ports for transferring ink into or out of inkjet head 100. Although the term "ink" is used herein, inkjet head 100 is capable of dispersing different types of liquid material used for printing.

Figure 2:
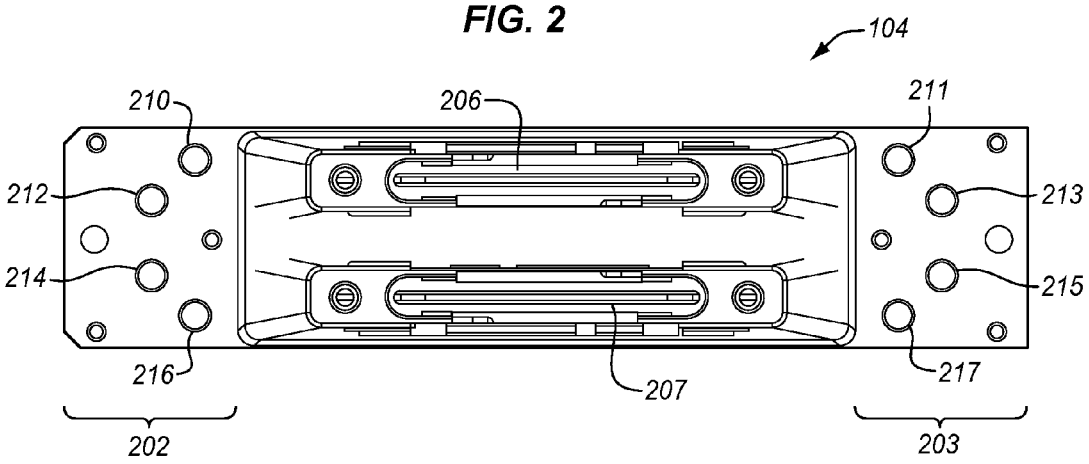
FIG. 2 illustrates an I/O side of an inkjet head in one example.
Figure 3:
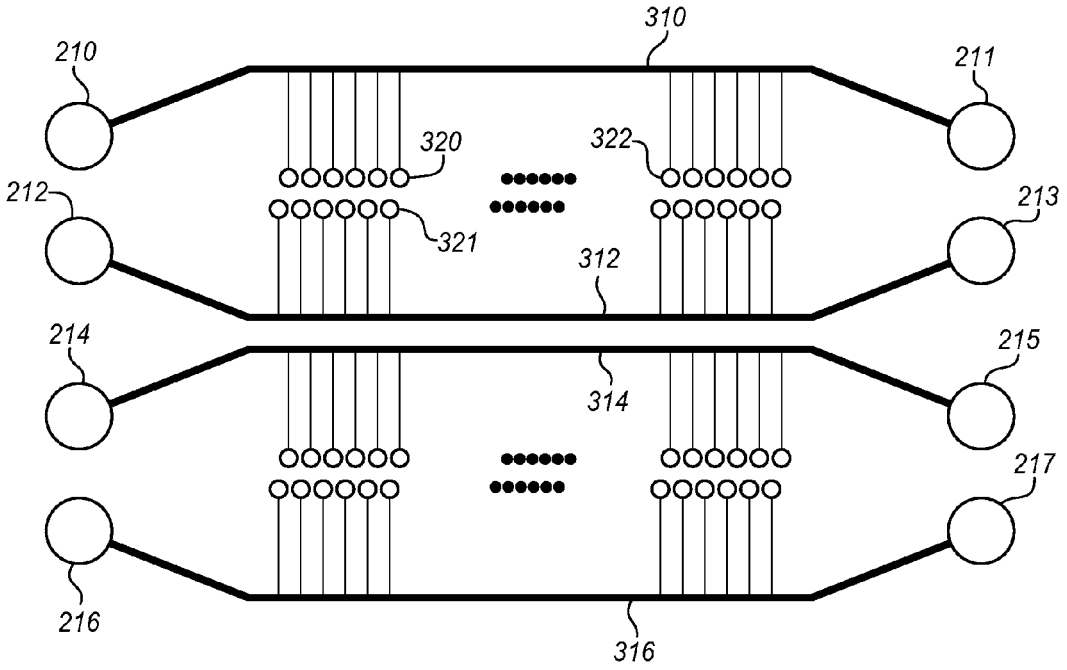
FIG. 3 is a schematic view of an inkjet head.

FIG. 2 illustrates the I/O side 104 of inkjet head 100 in one example. In the example shown in FIG. 2, inkjet head 100 is a four-color head. I/O side 104 has two ends 202-203 that are separated by electrical connectors 206-207. Each end 202-203 includes four ink ports. For example, end 202 includes ink ports 210, 212, 214, and 216. End 203 includes ink ports 211, 213, 215, and 217. An ink port represents an opening for receiving ink from an ink supply, or transferring ink out of inkjet head 100. Ink ports 210-217 provide a pathway to ink manifolds within inkjet head 100. An ink manifold is a conduit within an inkjet head for providing ink to a plurality of ink channels/nozzles for jetting. FIG. 3 is a schematic view of inkjet head 100 as shown in FIG. 2. Ink ports 210-211 provide pathways to an ink manifold 310 for a first color. Ink ports 212-213 provide pathways to an ink manifold 312 for a second color. Ink ports 214-215 provide pathways to an ink manifold 314 for a third color. Ink ports 216-217 provide pathways to an ink manifold 316 for a fourth color. Each of the ink manifolds 310-316 connects to a row of nozzles 320-322, and provides ink to the nozzles 320-322 for jetting.

Figure 4:
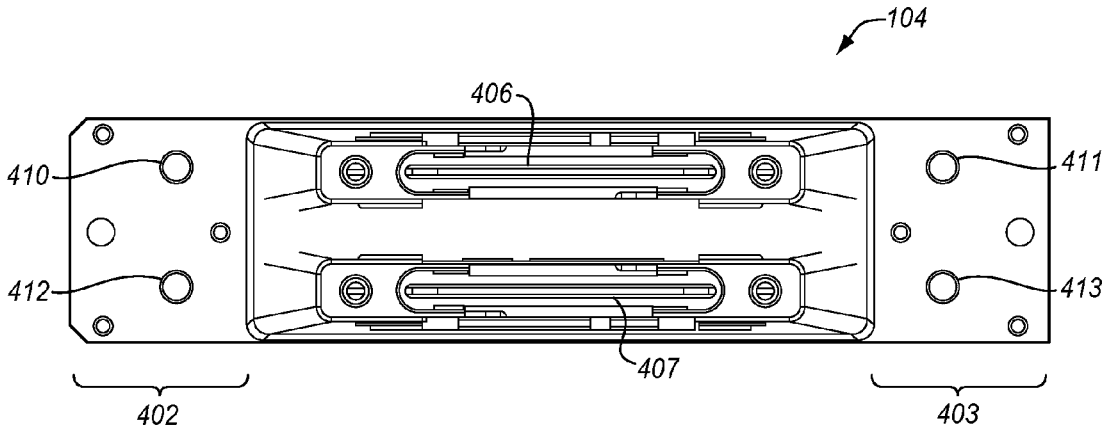
FIG. 4 illustrates an I/O side of an inkjet head in another example.
Figure 5:
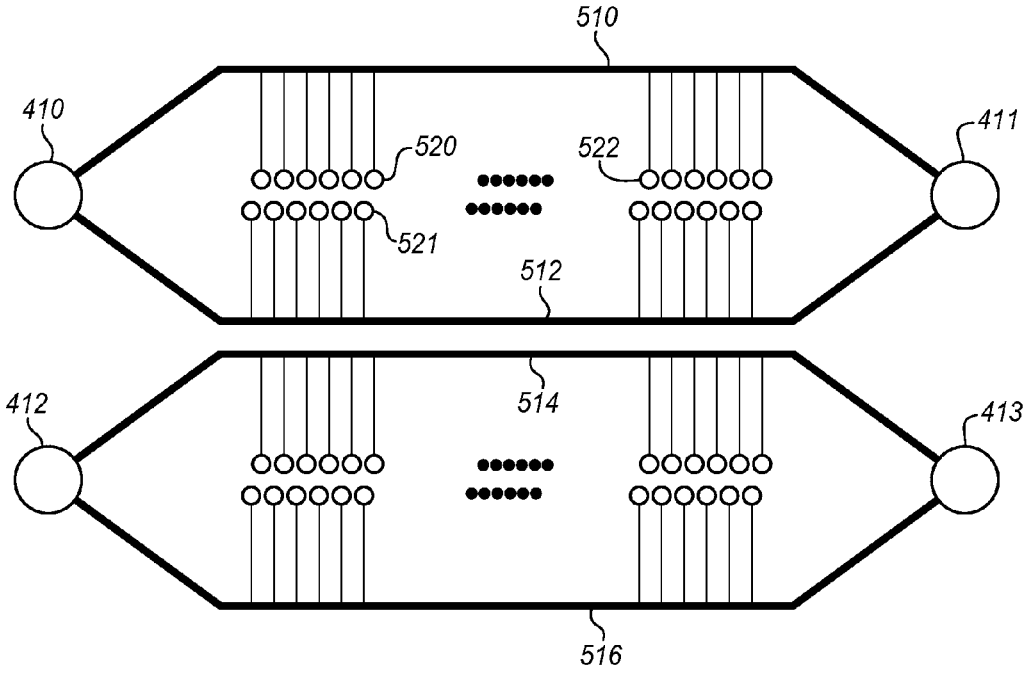
FIG. 5 is a schematic view of an inkjet head.

FIG. 4 illustrates the I/O side 104 of inkjet head 100 in another example. In the example shown in FIG. 4, inkjet head 100 is a two-color head. I/O side 104 has two ends 402-403 that are separated by electrical connectors 406-407. Each end 402-403 includes two ink ports. For example, end 402 includes ink ports 410 and 412. End 403 includes ink ports 411 and 413. FIG. 5 is a schematic view of inkjet head 100 as shown in FIG. 4. Ink ports 410-411 provide pathways to ink manifolds 510 and 512 for a first color. Ink ports 412-413 provide pathways to ink manifolds 514 and 516 for a second color. Each of the ink manifolds 510-516 connects to a row of nozzles 520-522, and provides ink to the nozzles 520-522 for jetting.

When using multi-color inkjet heads as described above, a user may want to reduce the number of colors that are used with an inkjet head. For example, if a user has a four-color inkjet head, he/she may want to operate the four-color inkjet head as a two-color or a single-color inkjet head. If a user has a two-color inkjet head, he/she may want to operate the two-color inkjet head as a single-color inkjet head. To accommodate this, ink port adapters are described herein that allow multi-color inkjet heads to be used with a reduced number of colors. For example, an ink port adapter may convert a four-color inkjet head for use as a two-color or a single-color inkjet head. An ink port adapter may convert a two-color inkjet head for use as a signal-color inkjet head. Descriptions of the ink port adapters are described below.

Figure 6:
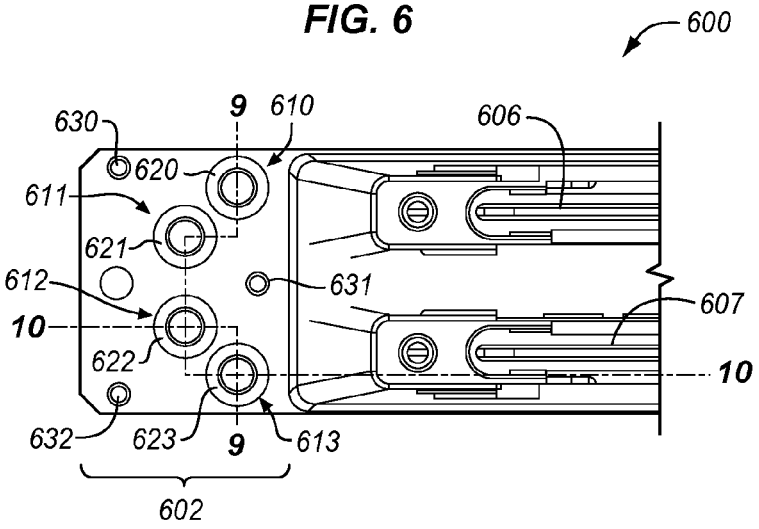
FIG. 6 illustrates one end of a four-color inkjet head in an exemplary embodiment.

FIG. 6 illustrates one end of a four-color inkjet head 600 in an exemplary embodiment. End 602 is separated from the other end (not shown) of inkjet head 600 by electrical connectors 606-607. End 602 includes four ink ports 610-613, which comprise openings for transferring ink to/from inkjet head 600. Although not visible in FIG. 6, each ink port 610-613 connects to an ink manifold within inkjet head 600. In this embodiment, ink ports 610-613 may each include a recess 620-623 for receiving an o-ring, which is described further below. End 602 also includes threaded holes 630-632 for receiving a fastening member, such as a screw or bolt.

Figure 7:
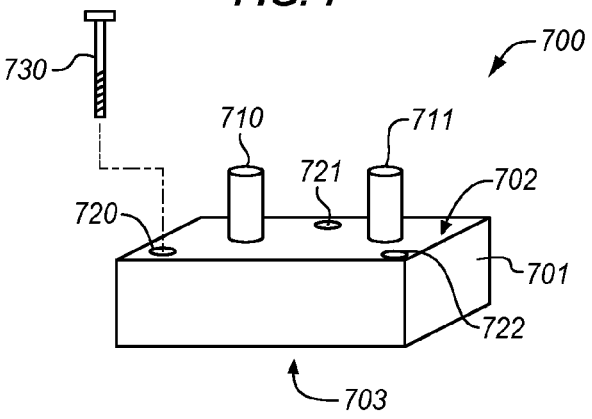
FIG. 7 is an isometric view of an ink port adapter in an exemplary embodiment.

Although inkjet head 600 is a four-color inkjet head, it may be used as a two-color inkjet head with the use of an ink port adapter as described herein. FIG. 7 is an isometric view of an ink port adapter 700 in an exemplary embodiment. Ink port adapter 700 is an apparatus configured to convert a four-color inkjet head to a two-color inkjet head. Ink port adapter 700 includes a body 701 having a top surface 702 and a bottom surface 703. Although the terms "top" and "bottom" are used herein, it is merely to distinguish the surfaces 702-703 in FIG. 7. The body 701 of ink port adapter 700 may be made from plastic, Teflon®, or any other desired material. Top surface 702 includes hose fittings 710-711, which are hollow cylindrical features that extend from top surface 702 to act as a connection point for a hose, such as from an ink reservoir. A hose is able to slide over each of hose fittings 710-711. Although not shown in FIG. 7, hose fittings 710-711 may be barbed or have other surface features for securing a hose. Ink port adapter 700 also includes a plurality of connecting holes 720-722 that pass from top surface 702 to bottom surface 703 to align with threaded holes 630-632 on inkjet head 600. Fastening members 730, such as screws or bolts, are inserted through connecting holes 720-722, and screw into threaded holes 630-632 to secure ink port adapter 700 to inkjet head 600.

Figure 8A:
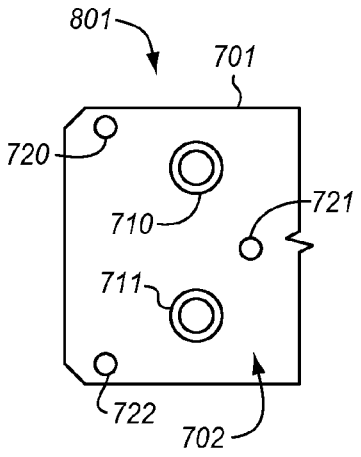
FIGS. 8A-8B illustrate top and bottom views of an ink port adapter in an exemplary embodiment.
Figure 8B:
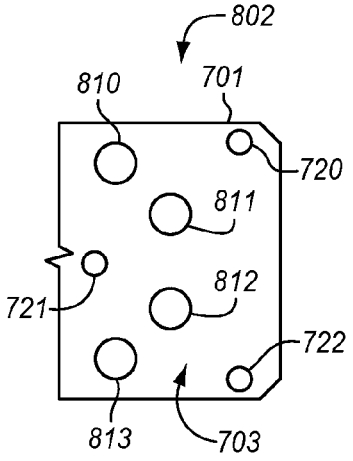

FIGS. 8A-8B illustrate top and bottom views of ink port adapter 700 in an exemplary embodiment. The top view 801 in FIG. 8A illustrates hose fittings 710-711 and connecting holes 720-722 on top surface 702 of ink port adapter 700. The bottom view 802 in FIG. 8B illustrates four openings 810-813 on bottom surface 703 of ink port adapter 700, and connecting holes 720-722. As is evident from top view 801 and bottom view 802, connecting holes 720-722 pass through the body 701 of ink port adapter 700 from top surface 702 to bottom surface 703. Openings 810-813 are configured to align with the four ink ports 610-613 of inkjet head 600 (see FIG. 6). Although not visible in FIGS. 8A-8B, an ink path passes through body 701 that connects hose fitting 710 to openings 810-811. Another separate ink path passes through body 701 that connects hose fitting 711 to openings 812-813. An ink path is a hollow channel through body 701 that allows ink to flow, such as between a hose fitting 710-711 on top surface 702 and multiple openings 810-813 on bottom surface 703.

Figure 9:
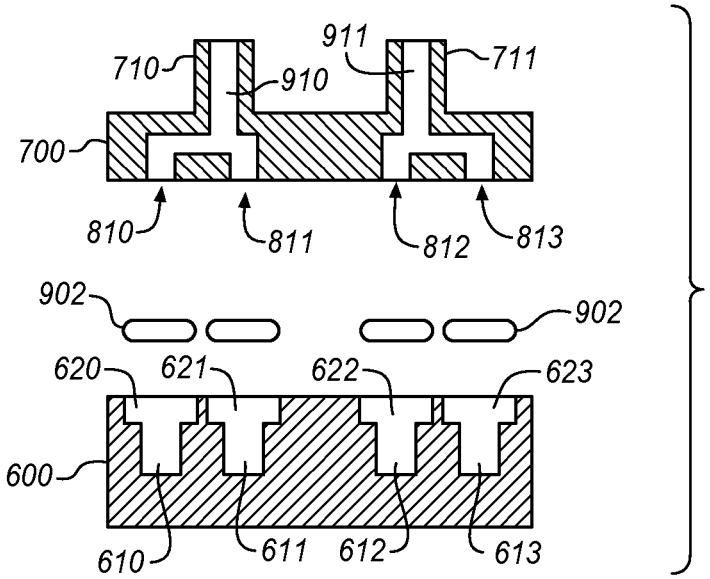
FIGS. 9-10 are cross-sectional views of an ink port adapter being attached to an inkjet head in an exemplary embodiment.
Figure 10:
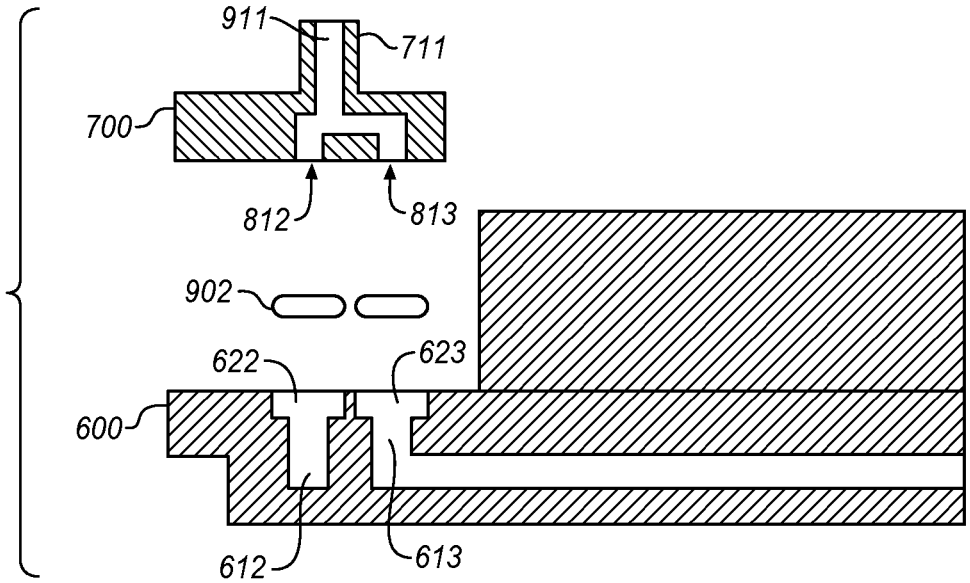

FIGS. 9-10 are cross-sectional views of ink port adapter 700 being attached to inkjet head 600 in an exemplary embodiment. FIG. 9 is a cross-section along line 9-9 of FIG. 6, and FIG. 10 is a cross-section along line 10-10 of FIG. 6. Ink ports 610-613 of inkjet head 600 include recesses 620-623, respectively. O-rings 902 may be inserted into recesses 620-623. When compressed, o-rings 902 provide a seal between ink port adapter 700 and inkjet head 600. Openings 810-813 on ink port adapter 700 align with ink ports 610-613 to provide a fluid connection. An ink path 910 connects hose fitting 710 to openings 810-811. Therefore, ink flowing from a hose into hose fitting 710 will travel through adapter 700 to both opening 810 and opening 811. Another ink path 911 connects hose fitting 711 to openings 812-813. Therefore, ink flowing from a hose into hose fitting 711 will travel through adapter 700 to both opening 812 and opening 813.

When in use, ink port adapter 700 is placed onto end 602 of inkjet head 600, and is fastened to inkjet head 600 with fastening members 730. In FIG. 6, the other end (not shown) of inkjet head 600 will have a similar configuration with ink ports, and an ink port adapter may be attached to the other end of inkjet head 600 in a similar manner. Hoses are connected to hose fittings 710-711. The hoses may be attached to ink reservoirs of different colors to supply two colors of ink to inkjet head 600. When one color of ink is supplied through the hose connected to hose fitting 710, the ink will flow through hose fitting 710, through ink path 910, and out openings 810-811 into ink ports 610-611 of inkjet head 600. When another color of ink is supplied through the hose connected to hose fitting 711, the ink will flow through hose fitting 711, through ink path 911, and out openings 812-813 into ink ports 612-613 of inkjet head 600. Thus, even though inkjet head 600 has four ink ports 610-613 on each end for receiving four colors of ink, ink port adapter 700 allows inkjet head 600 to operate while receiving only two colors of ink.

Although o-rings 902 are illustrated in FIGS. 9-10, other types of sealing mechanisms may be used between ink port adapter 700 and inkjet head 600. For example, a gasket may be used as a sealing mechanism in another embodiment. When a gasket is used, recesses 620-623 may not be needed in ink ports 610-613.

Figure 11:
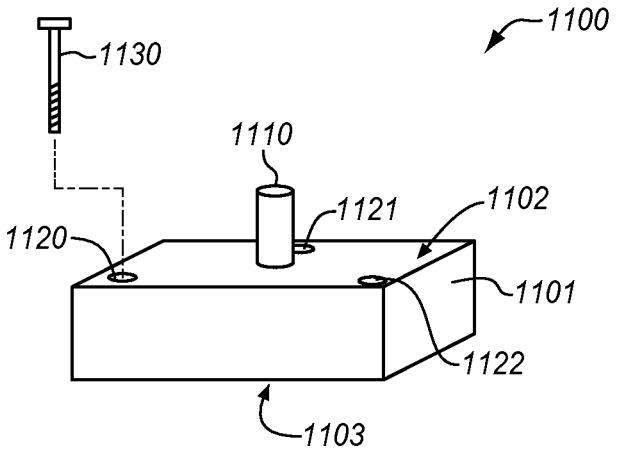
FIG. 11 is an isometric view of an ink port adapter in an exemplary embodiment.

Inkjet head 600 (see FIG. 6) may also be used as a single-color inkjet head with the use of another ink port adapter. FIG. 11 is an isometric view of an ink port adapter 1100 in an exemplary embodiment. Ink port adapter 1100 is an apparatus configured to convert a four-color inkjet head to a single-color inkjet head. Ink port adapter 1100 includes a body 1101 having a top surface 1102 and a bottom surface 1103. Top surface 1102 includes a hose fitting 1110. Ink port adapter 1100 also includes a plurality of connecting holes 1120-1122 that pass from top surface 1102 to bottom surface 1103 to align with threaded holes 630-632 on inkjet head 600. Fastening members 1130 are inserted through connecting holes 1120-1122, and screw into threaded holes 630-632 to secure ink port adapter 1100 to inkjet head 600.

Figure 12A:
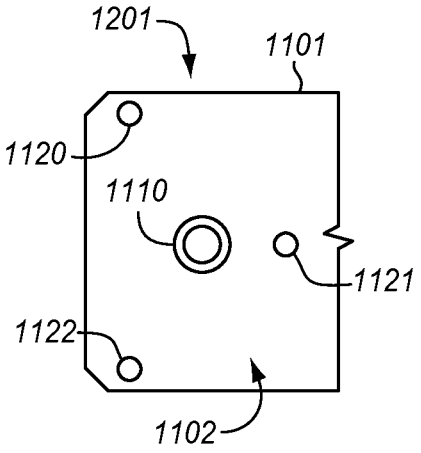
FIGS. 12A-12B illustrate top and bottom views of an ink port adapter in an exemplary embodiment.
Figure 12B:
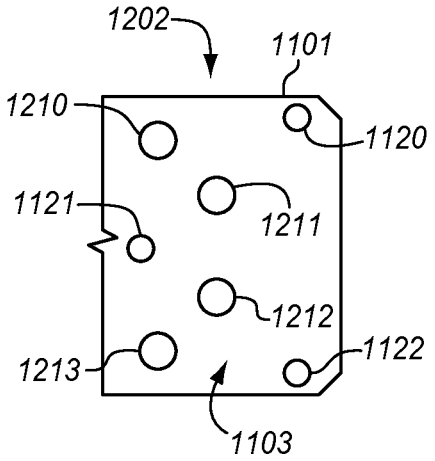

FIGS. 12A-12B illustrate top and bottom views of ink port adapter 1100 in an exemplary embodiment. The top view 1201 in FIG. 12A illustrates hose fitting 1110 and connecting holes 1120-1122 on top surface 1102 of ink port adapter 1100. The bottom view 1202 in FIG. 12B illustrates four openings 1210-1213 on bottom surface 1103 of ink port adapter 1100, and connecting holes 1120-1122. As is evident from top view 1201 and bottom view 1202, connecting holes 1120-1122 pass through the body 1101 of ink port adapter 1100 from top surface 1102 to bottom surface 1103. Openings 1210-1213 are configured to align with the four ink ports 610-613 of inkjet head 600 (see FIG. 6). Although not visible in FIGS. 12A-12B, an ink path passes through body 1101 that connects hose fitting 1110 to openings 1210-1213.

Figure 13:
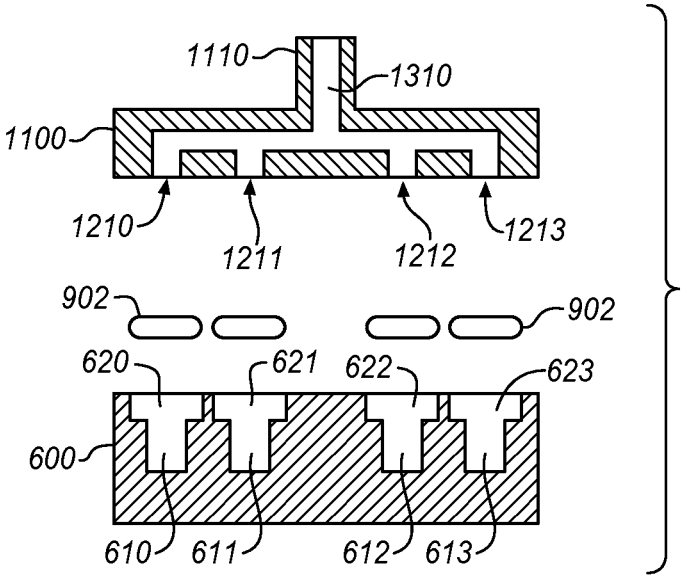
FIGS. 13-14 are cross-sectional views of an ink port adapter being attached to an inkjet head in an exemplary embodiment.
Figure 14:
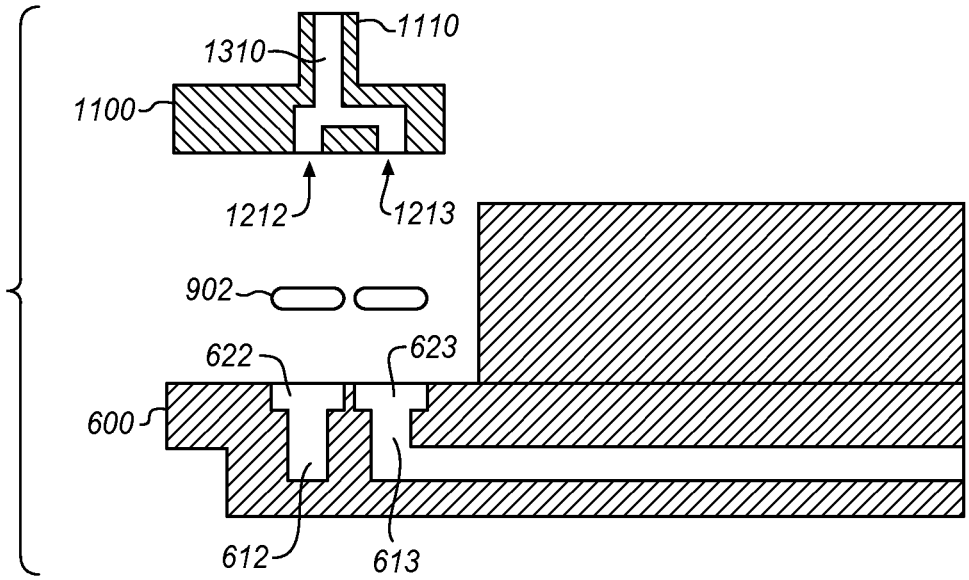

FIGS. 13-14 are cross-sectional views of ink port adapter 1100 being attached to inkjet head 600 in an exemplary embodiment. FIG. 13 is a cross-section along line 9-9 of FIG. 6, and FIG. 14 is a cross-section along line 10-10 of FIG. 6. Ink ports 610-613 of inkjet head 600 include recesses 620-623, respectively. O-rings 902 may be inserted into recesses 620-623. When compressed, o-rings 902 provide a seal between ink port adapter 1100 and inkjet head 600. Openings 1210-1213 on ink port adapter 1100 align with ink ports 610-613 to provide a fluid connection. An ink path 1310 connects hose fitting 1110 to openings 1210-1213. Therefore, ink flowing from a hose into hose fitting 1110 will travel through adapter 1100 to each of openings 1210-1213.

When in use, ink port adapter 1100 is placed onto end 602 of inkjet head 600, and is fastened to inkjet head 600 with fastening members 1130. In FIG. 6, the other end (not shown) of inkjet head 600 will have a similar configuration with ink ports, and an ink port adapter may be attached to the other end of inkjet head 600 in a similar manner. A hose is connected to hose fitting 1110. The hose may be attached to an ink reservoir of a single color to supply one color of ink to inkjet head 600. When one color of ink is supplied through the hose connected to hose fitting 1110, the ink will flow through hose fitting 1110, through ink path 1310, and out openings 1210-1213 into ink ports 610-613 of inkjet head 600. Thus, even though inkjet head 600 has four ink ports on each end for receiving four colors of ink, ink port adapter 1100 allows inkjet head 600 to operate while receiving only one color of ink.

Figure 15:
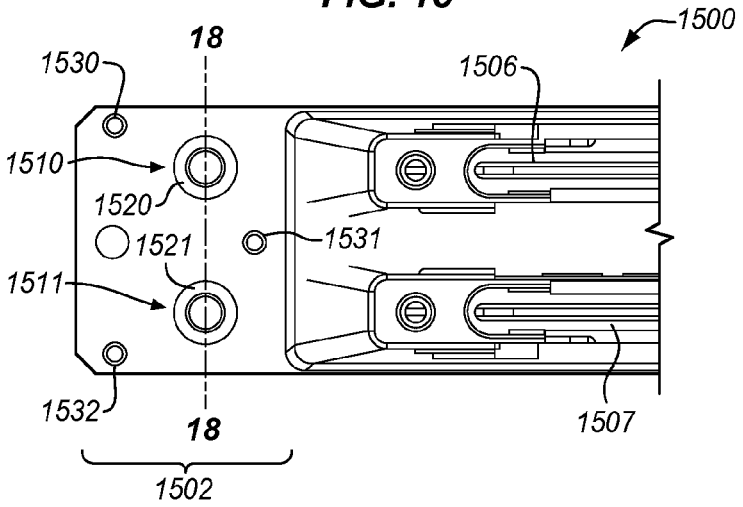
FIG. 15 illustrates one end of a two-color inkjet head in an exemplary embodiment.

FIG. 15 illustrates one end of a two-color inkjet head 1500 in an exemplary embodiment. End 1502 is separated from the other end (not shown) of inkjet head 1500 by electrical connectors 1506-1507. End 1502 includes two ink ports 1510-1511, which comprise openings for transferring ink to/from inkjet head 1500. Although not visible in FIG. 15, each ink port 1510-1511 connects to an ink manifold within inkjet head 1500. In this embodiment, ink ports 1510-1511 may each include a recess 1520-1521 for receiving an o-ring, which is described further below. End 1502 also includes threaded holes 1530-1532 for receiving a fastening member, such as a screw or bolt.

Figure 16:
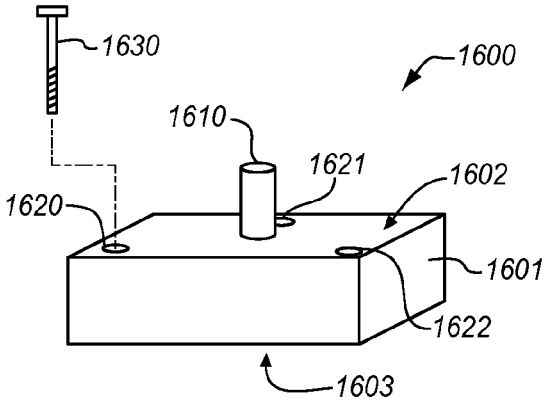
FIG. 16 is an isometric view of an ink port adapter in an exemplary embodiment.

Although inkjet head 1500 is a two-color inkjet head, it may be used as a single-color inkjet head with the use of an ink port adapter. FIG. 16 is an isometric view of an ink port adapter 1600 in an exemplary embodiment. Ink port adapter 1600 is an apparatus configured to convert a two-color inkjet head to a single-color inkjet head. Ink port adapter 1600 includes a body 1601 having a top surface 1602 and a bottom surface 1603. Top surface 1602 includes a hose fitting 1610. Ink port adapter 1600 also includes a plurality of connecting holes 1620-1622 that pass from top surface

1602 to bottom surface 1603 to align with threaded holes 1530-1532 on inkjet head 1500. Fastening members 1630, such as screws or bolts, are inserted through connecting holes 1620-1622, and screw into threaded holes 1530-1532 to secure ink port adapter 1600 to inkjet head 1500.

Figure 17A:
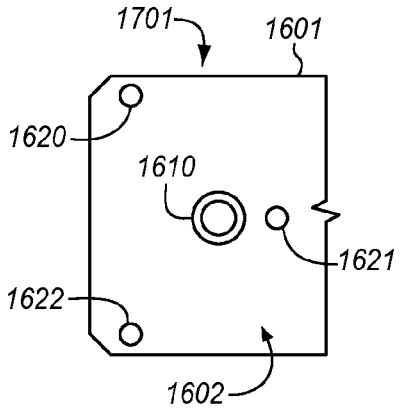
FIGS. 17A-17B illustrate top and bottom views of an ink port adapter in an exemplary embodiment.
Figure 17B:
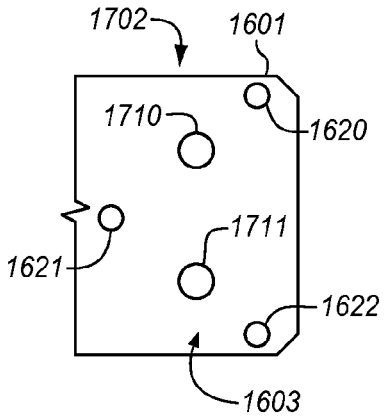

FIGS. 17A-17B illustrate top and bottom views of ink port adapter 1600 in an exemplary embodiment. The top view 1701 in FIG. 17A illustrates hose fitting 1610 and connecting holes 1620-1622 on top surface 1602 of ink port adapter 1600. The bottom view 1702 in FIG. 17B illustrates two openings 1710-1711 on bottom surface 1603 of ink port adapter 1600, and connecting holes 1620-1622. As is evident from top view 1701 and bottom view 1702, connecting holes 1620-1622 pass through the body 1601 of ink port adapter 1600 from top surface 1602 to bottom surface 1603. Openings 1710-1711 are configured to align with the two ink ports 1510-1511 of inkjet head 1500 (see FIG. 15). Although not visible in FIGS. 17A-17B, an ink path passes through body 1601 that connects hose fitting 1610 to openings 1710-1711.

Figure 18:
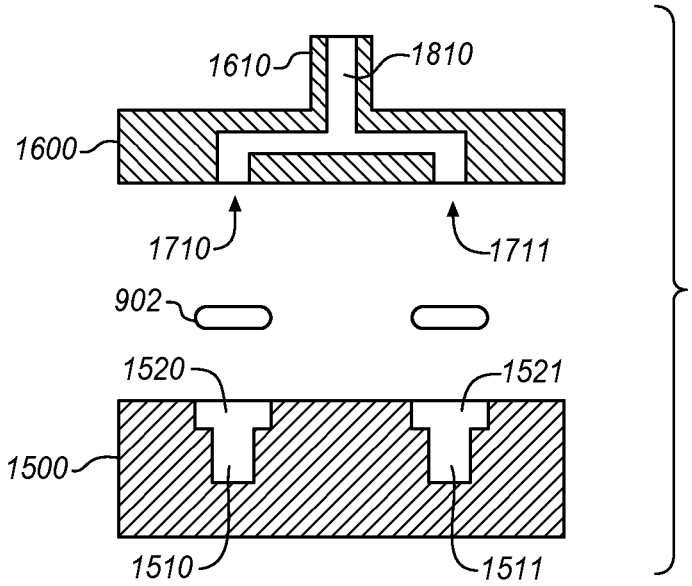
FIG. 18 is a cross-sectional view of an ink port adapter being attached to an inkjet head in an exemplary embodiment.

FIG. 18 is a cross-sectional view of ink port adapter 1600 being attached to inkjet head 1500 in an exemplary embodiment. FIG. 18 is a cross-section along line 18-18 of FIG. 15. Ink ports 1510-1511 of inkjet head 1500 include recesses 1520-1521, respectively. O-rings 902 may be inserted into recesses 1520-1521. When compressed, o-rings 902 provide a seal between ink port adapter 1600 and inkjet head 1500. Openings 1710-1711 on ink port adapter 1600 align with ink ports 1510-1511 to provide a fluid connection. An ink path 1810 connects hose fitting 1610 to openings 1710-1711. Therefore, ink flowing from a hose into hose fitting 1610 will travel through adapter 1600 to both opening 1710 and opening 1711.

When in use, ink port adapter 1500 is placed onto end 1502 of inkjet head 1500, and is fastened to inkjet head 1500 with fastening members 1630. In FIG. 15, the other end (not shown) of inkjet head 1500 will have a similar configuration with ink ports, and an ink port adapter may be attached to the other end of inkjet head 1500 in a similar manner. A hose is connected to hose fitting 1610. The hose may be attached to an ink reservoir of a single color to supply one color of ink to inkjet head 1500. When one color of ink is supplied through the hose connected to hose fitting 1610, the ink will flow through hose fitting 1610, through ink path 1810, and out openings 1710-1711 into ink ports 1510-1511 of inkjet head 1500. Thus, even though inkjet head 1500 has two ink ports on each end for receiving two colors of ink, ink port adapter 1600 allows inkjet head 1500 to operate while receiving only one color of ink.

The ink port adapters described above are able to transform multi-color inkjet heads for use with fewer colors. For example, if an ink port adapter is attached to a four-color inkjet head, then the four-color inkjet head may be used as a two-color or single-color inkjet head. If an ink port adapter is attached to a two-color inkjet head, then the two-color inkjet head may be used as a single-color inkjet head. Therefore, a consumer may not have to buy new inkjet heads for different applications. A consumer may buy a four-color head, and use that four-color head for four-color printing in one application, two-color printing in another application (with an adapter), or single-color printing in yet another application (with an adapter). Use of the ink port adapters described above advantageously gives the consumer flexibility in printing with an individual inkjet head.

Although specific embodiments were described herein, the scope of the invention is not limited to those specific embodiments. The scope of the invention is defined by the following claims and any equivalents thereof.

I claim:

1. An apparatus comprising:

an ink port adapter comprising:

a body having a first surface and a second surface;

two hose fittings that extend from the first surface of the body for connecting to hoses;

four openings on the second surface of the body that align with four ink ports on one end of a four-color inkjet head;

a first ink path through the body that connects a first one of the hose fittings to a first one of the openings and to a second one of the openings; and a second ink path through the body that connects a second one of the hose fittings to a third one of the openings and to a fourth one of the openings.

2. The apparatus of claim 1 further comprising:

o-rings to be compressed between the four openings of the ink port adapter and the four ink ports of the four-color inkjet head.

3. The apparatus of claim 2 wherein:

the o-rings are seated in recesses in the four ink ports of the four-color inkjet head.

4. The apparatus of claim 1 further comprising:

fastening members configured to attach the ink port adapter to the four-color inkjet head.

5. The apparatus of claim 4 wherein:

the ink port adapter further includes a plurality of connecting holes through the body to align with threaded holes on the four-color inkjet head;

wherein the fastening members are inserted through the connecting holes of the ink port adapter to screw into the threaded holes on the four-color inkjet head.

6. The apparatus of claim 1 wherein:

a first one of the hose fittings connects with a first hose that supplies a first color of ink; and a second one of the hose fittings connects with a second hose that supplies a second color of ink.

7. An apparatus comprising:

an ink port adapter comprising:

a body having a first surface and a second surface;

a hose fitting that extends from the first surface of the body for connecting to a hose;

four openings on the second surface of the body that align with four ink ports on one end of a four-color inkjet head; and an ink path through the body that connects the hose fitting to each of the openings.

8. The apparatus of claim 7 further comprising:

o-rings to be compressed between the four openings of the ink port adapter and the four ink ports of the four-color inkjet head.

9. The apparatus of claim 8 wherein:

the o-rings are seated in recesses in the four ink ports of the four-color inkjet head.

10. The apparatus of claim 7 further comprising:

fastening members configured to attach the ink port adapter to the four-color inkjet head.

11. The apparatus of claim 10 wherein:

the ink port adapter further includes a plurality of connecting holes through the body to align with threaded holes on the four-color inkjet head;

wherein the fastening members are inserted through the connecting holes of the ink port adapter to screw into the threaded holes on the four-color inkjet head.

12. The apparatus of claim 7 wherein:

the hose fitting connects with a hose that supplies a single color of ink.

* * * * *